US009476163B1

(12) United States Patent
Patram

(10) Patent No.: US 9,476,163 B1
(45) Date of Patent: Oct. 25, 2016

(54) WOOD GRAIN CONCRETE PAVING SLABS

(71) Applicant: Barkman Concrete Ltd., Steinbach (CA)

(72) Inventor: Wayne Patram, Steinbach (CA)

(73) Assignee: Barkman Concrete Ltd, Steinbach, MB (CA)

( * ) Notice: Subject to any disclaimer, the term of this patent is extended or adjusted under 35 U.S.C. 154(b) by 0 days.

(21) Appl. No.: 14/742,880

(22) Filed: Jun. 18, 2015

(51) Int. Cl.

| | |
|---|---|
| ***E01C 5/06*** | (2006.01) |
| ***E01C 11/00*** | (2006.01) |
| ***E01C 5/00*** | (2006.01) |
| ***B44F 9/02*** | (2006.01) |

(52) U.S. Cl.
CPC . *E01C 5/06* (2013.01); *B44F 9/02* (2013.01); *E01C 5/003* (2013.01); *E01C 5/005* (2013.01); *E01C 11/00* (2013.01); *E01C 2201/02* (2013.01)

(58) Field of Classification Search
CPC ..... E01C 5/06; E01C 5/003; E01C 5/005; E01C 11/00; B44F 9/02
See application file for complete search history.

(56) References Cited

U.S. PATENT DOCUMENTS

| | | | | | |
|---|---|---|---|---|---|
| 1,340,896 | A * | 5/1920 | Jennison | E01C 5/14 | 404/38 |
| 2,095,012 | A * | 10/1937 | Renkert | E01C 5/04 | 404/38 |
| 4,016,692 | A * | 4/1977 | Jordan | B28B 17/0018 | 52/314 |
| 4,313,775 | A * | 2/1982 | Moore | B44F 9/04 | 144/346 |
| 5,054,957 | A * | 10/1991 | Johnson, II | E01C 5/00 | 404/41 |
| 5,261,984 | A * | 11/1993 | Minnick | B29C 33/3878 | 156/209 |
| 5,281,047 | A * | 1/1994 | Skaug | E01C 5/22 | 404/31 |
| 7,823,358 | B2 * | 11/2010 | McStay | B44C 1/28 | 404/34 |
| 8,672,580 | B1 * | 3/2014 | Garceau | E01C 19/508 | 404/75 |
| 2011/0151193 | A1 * | 6/2011 | Cantley | B44F 9/02 | 428/151 |
| 2016/0010288 | A1 * | 1/2016 | Castonguay | B44C 1/28 | 404/41 |

* cited by examiner

*Primary Examiner* — Abigail A Risic
(74) *Attorney, Agent, or Firm* — Ade & Company Inc.; Adrian D. Battison

(57) ABSTRACT

A set of cast concrete paving slabs is laid in a pattern side by side and end to end to cover an area to be paved. Each of the slabs members has side and end spacer abutments to hold an adjacent slab member at a predetermined spacing. Each of the slabs has a longitudinal slot in the upper surface defining a false joint parallel to the sides so as to divide the upper surface into parallel strips. There are different types of slabs some with both strips divided by transverse slots and some with only one strip with a slot. This forms in the finished product apparent strip pieces of many different lengths to simulate wood planks. Each of the parallel strips has a molded upper surface defining a series of wavy lines recessed from other parts of the upper surface and dyed darker than the remaining part of the slab thus simulating a wood grain appearance.

13 Claims, 8 Drawing Sheets

WOOD GRAIN CONCRETE PAVING SLABS

This invention relates to cast concrete paving slabs and to a set of paving slabs which can be laid in a pattern to provide a wood grain appearance.

SUMMARY OF THE INVENTION

According to the invention there is provided a set of cast concrete paving slabs arranged to be laid in a pattern to cover an area to be paved, the set of slabs comprising:

a plurality of slab members;

each slab member having a bottom surface for laying in the area and an upper surface for presenting for viewing when laid;

each slab member having a first side, a second side parallel to the first side, a first end and a second end;

the slab members being arranged to be laid side by side and end to end to cover the area;

each of the slab members having spacer abutments attached thereto at the sides and ends so as to hold an adjacent slab member at a predetermined spacing to form a spaced joint therebetween;

each of the slab members having at least one slot in the upper surface defining a false joint and extending along the length of the slab member parallel to the sides so as to divide the upper surface into a plurality of parallel strips;

each of the parallel strips having a molded upper surface defining a series of wavy lines recessed from other parts of the upper surface and simulating a wood grain appearance.

Preferably each of the slab members of the set has only two parallel strips but embodiments are possible in which more than two strips are provided.

Preferably the recessed wavy lines contain a dye in the concrete which is different from that in the other parts of the upper surface. This provision of a dye material absorbed into the concrete at the recessed lines which is typically darker than the remainder of the concrete slab provides an effective simulation of the wood grain. That is the different dye in the recessed wavy lines is provided only in the recessed wavy lines so that the remainder of the paving slabs is of a common color.

Preferably the parallel strips have first ends at the first end of the slab member which are longitudinally offset and preferably the parallel strips have second ends at the second end of the slab member which are longitudinally offset by a distance equal to a distance of the offset of the first ends. This provides symmetrical arrangements which can be fitted together in different patterns.

Preferably, in an arrangement in which each of the slab members has only two strips, one of the strips of one or more of the set has a slot in the upper surface defining a false joint and extending transverse to the length of the slab member at right angles to the sides so as to divide the upper surface into a plurality of end to end strips.

Also preferably in this arrangement both of the strips of at least one other of the set has a slot in the upper surface defining a false joint and extending transverse to the length of the slab member at right angles to the sides so as to divide the upper surface into a plurality of end to end strips.

Preferably the simulated wood grain appearance of each of the strips of each of the slab members of the set has a pattern which is different from the others.

Preferably the recessed wavy lines have a depth of recess from the remainder of the upper surface which is in the range 0.1 mm to 2.75 mm.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 8:
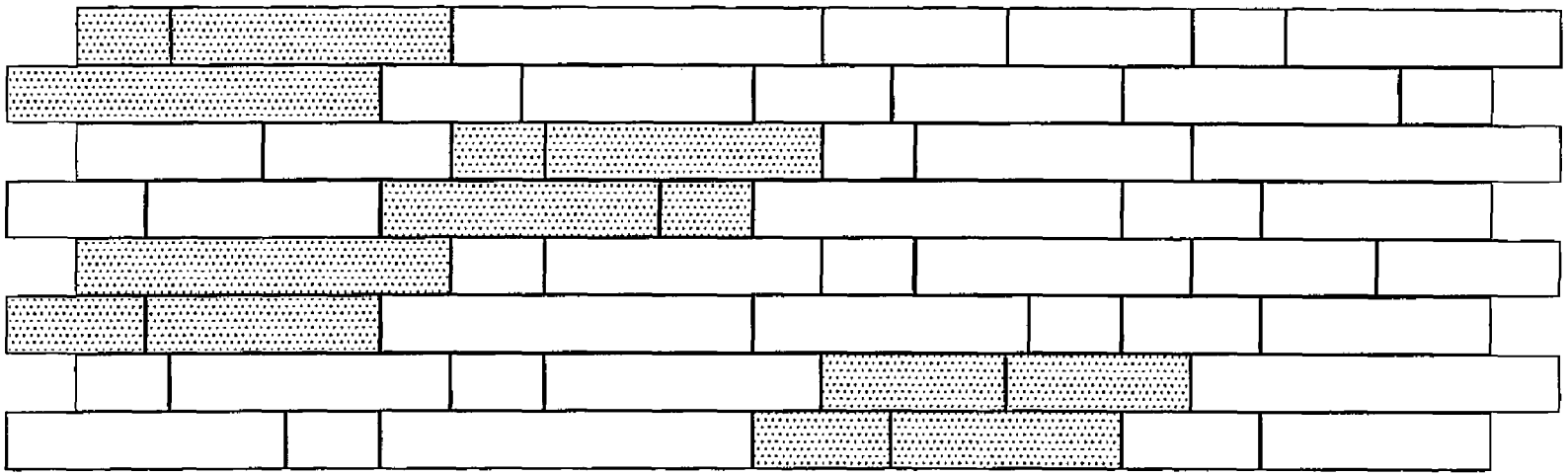
FIG. 8 is a top plan view of the set of the paving slabs of FIGS. 1, 2, 3 and 4 laid over an area to be covered and showing the interaction between the slabs.

In FIGS. 1 to 4 is shown the four slabs of a set of cast concrete paving slabs arranged to be laid in a pattern to cover an area to be paved. In FIG. 8 the slabs of FIGS. 1 to 4 are shown laid in patterns where the different shapes combine to provide a pleasing effect as described in more detail hereinafter. The slabs are shown in plan view in FIGS. 1 to 4 and 8 so that the various shapes of the slabs can be readily determined.

Figure 5:
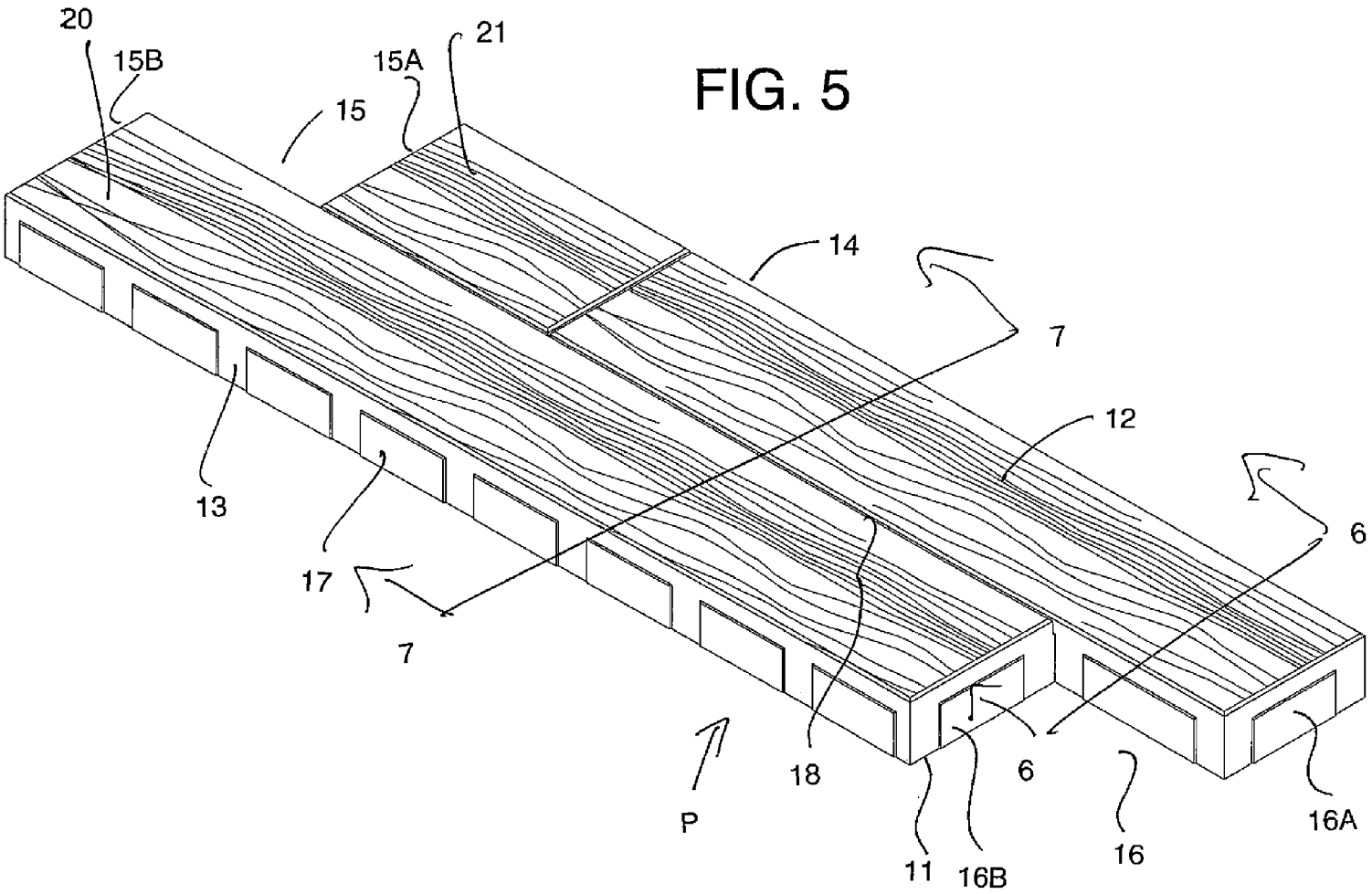
FIG. 5 is an isometric view of the concrete slab of FIG. 1.
Figure 6:
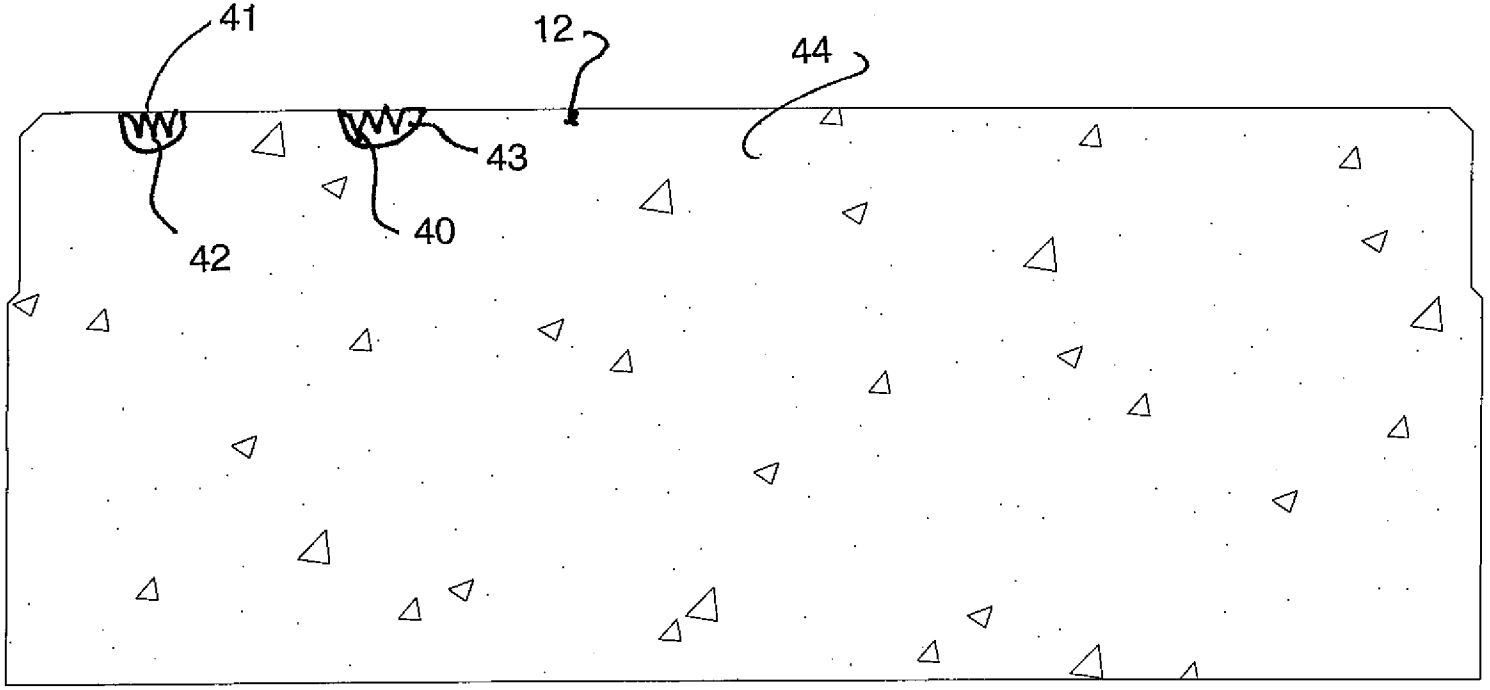
FIG. 6 is a cross-sectional view along the lines 6-6 of FIG. 5.
Figure 7:
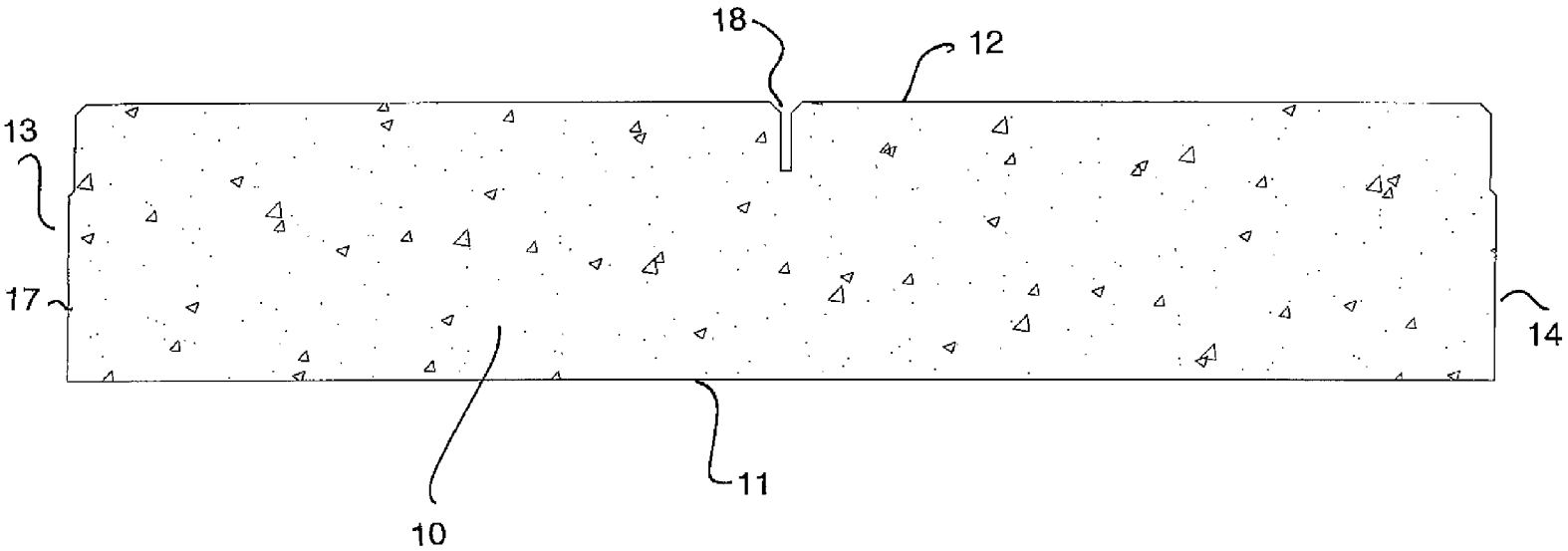
FIG. 7 is a cross-sectional view along the lines 7-7 of FIG. 5.

The construction of the slabs is better shown in FIGS. 5, 6 and 7 where each slab 10 has a bottom surface 11 for laying in the area and an upper surface 12 for presenting for viewing when laid. Each slab has a first side 13, a second side 14 parallel to the first side, a first end 15 and a second end 16 so that the slab can be laid side by side and end to end to cover the area to be covered by the pattern of slabs.

Each of the slabs has a series of rectangular spacer abutments 17 cast into the sides so as to be attached thereto along the sides and ends so as to contact the abutment of an adjacent slab and hold the adjacent slab member at a predetermined spacing to form a spaced joint therebetween. The abutments are recessed from the top surface 12 and form a layer of constant thickness on the side or end surface of the slab.

Each of the slab members has a longitudinal slot cast into the upper surface defining a false joint and extending along the length of the slab member parallel to the sides 13 and 14 so as to divide the upper surface into a pair of parallel strips 20 and 21. The slot 18 mimics the space between two of the slabs as defined by the spacer abutments so that the depth of the slot is approximately equal to the spacing of the abutments from the top surface and the width of the slot is constant and approximately equal to the thickness of the two abutting abutments.

Each of the slabs is arranged so that the two parallel strips have first ends 15A and 15B of the strips 20 and 21 at the first end 15 of the slab member which are longitudinally offset and symmetrically the second ends 16A and 16B at the second end 16 are longitudinally offset by a distance equal to a distance of the offset of the first ends. These longitudinal offsets are the same at the ends of the same slab and are equal to the distance of all the other slabs of the set.

In addition, at least one of the strips of each of the set of slabs shown in FIGS. 1 to 4 has at least one slot in the upper surface defining a false joint and extending transverse to the length of the slab member at right angles to the sides so as to divide the upper surface into a plurality of end to end strips. Thus the slab of FIG. 1 has a slot 25 in the strip 20 and the strip 21 is continuous. Thus the slab of FIG. 2 has a slot 26 in the strip 21 and the strip 20 is continuous.

Figure 1:
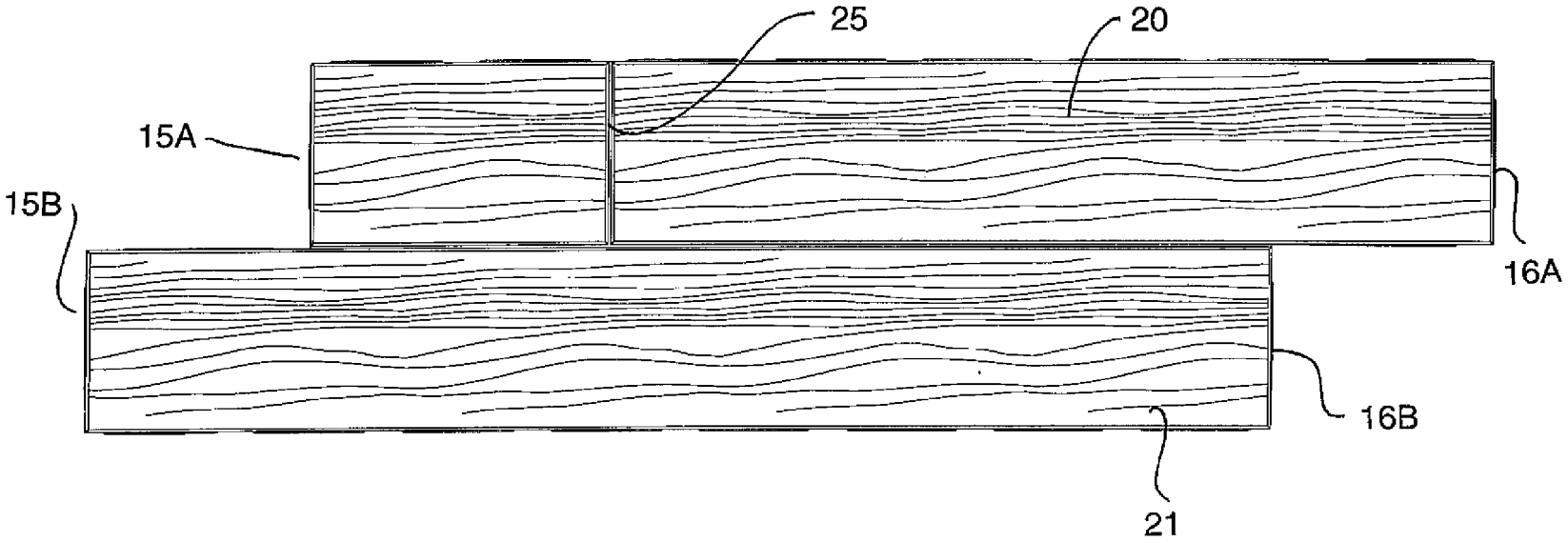
FIG. 1 is a top plan view of a first single cast concrete paving slab of a set of such slabs according to the invention.
Figure 2:
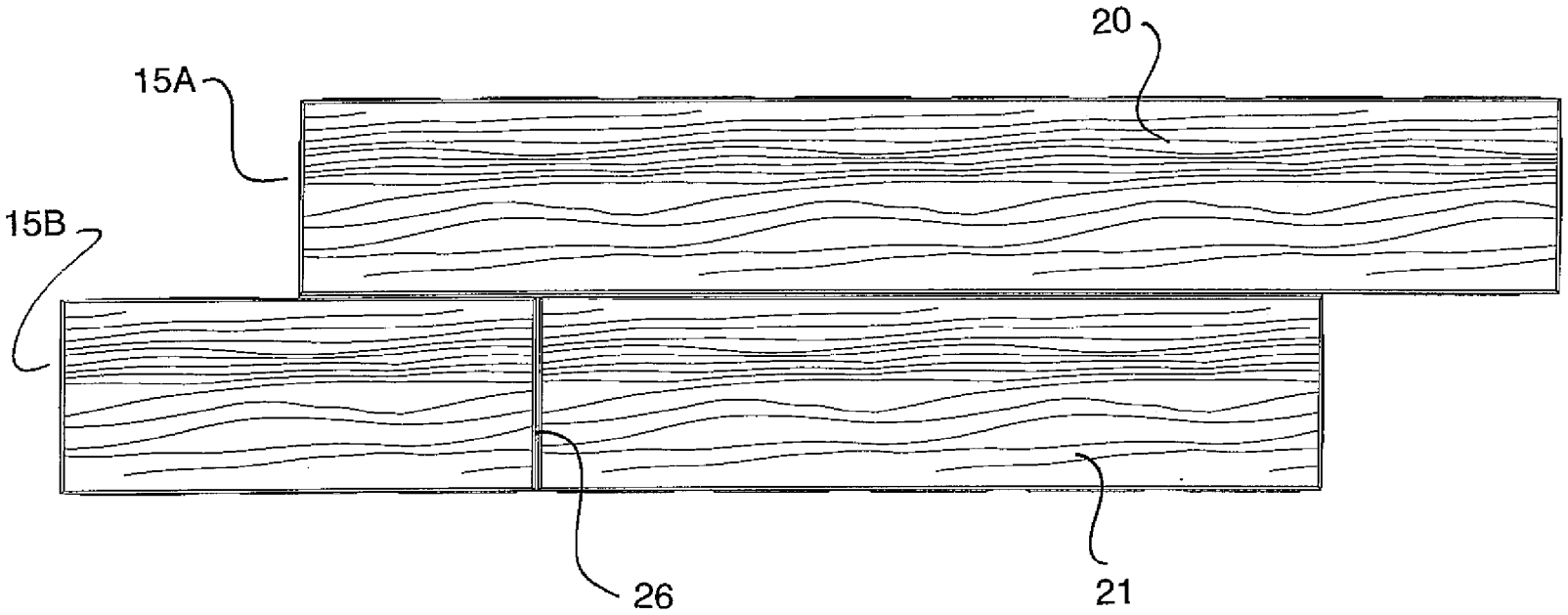
FIG. 2 is a top plan view of a second single cast concrete paving slab of the set of such slabs.
Figure 3:
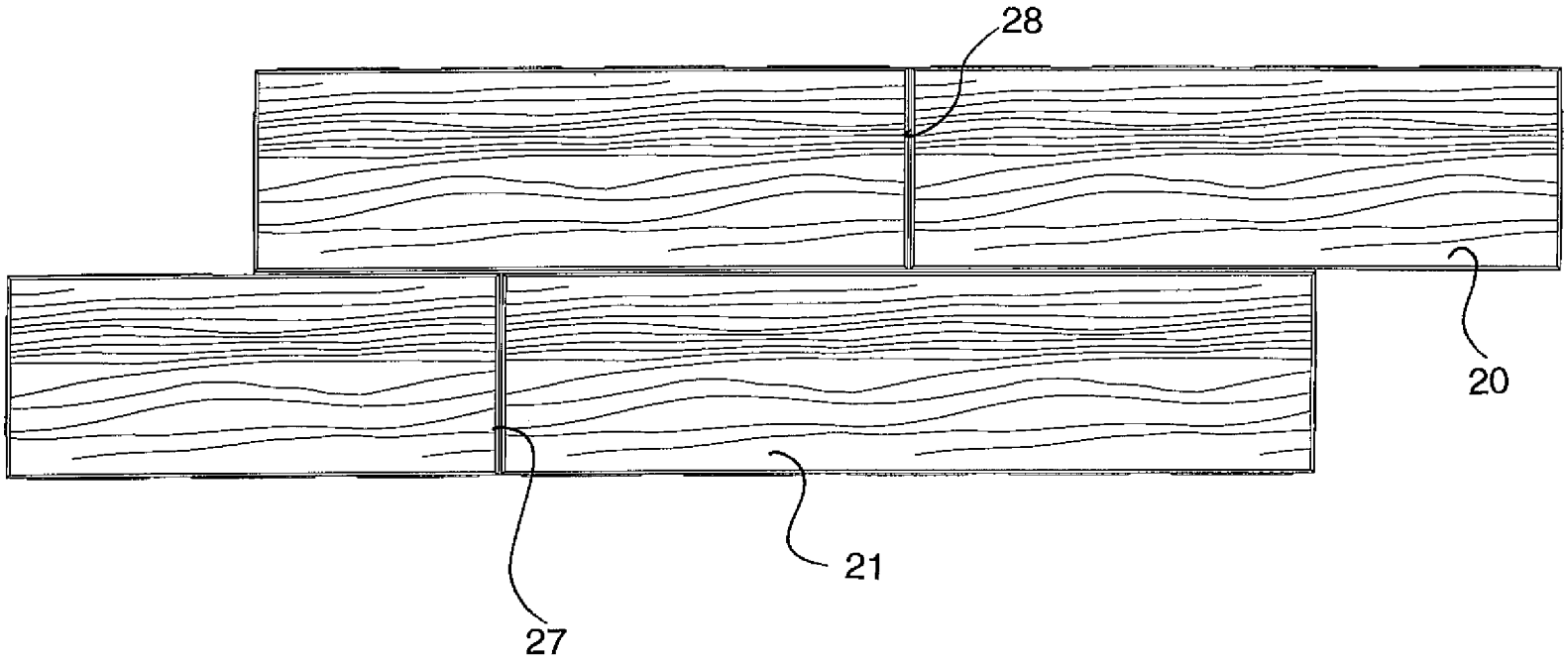
FIG. 3 is a top plan view of a third single cast concrete paving slab of the set of such slabs.
Figure 4:
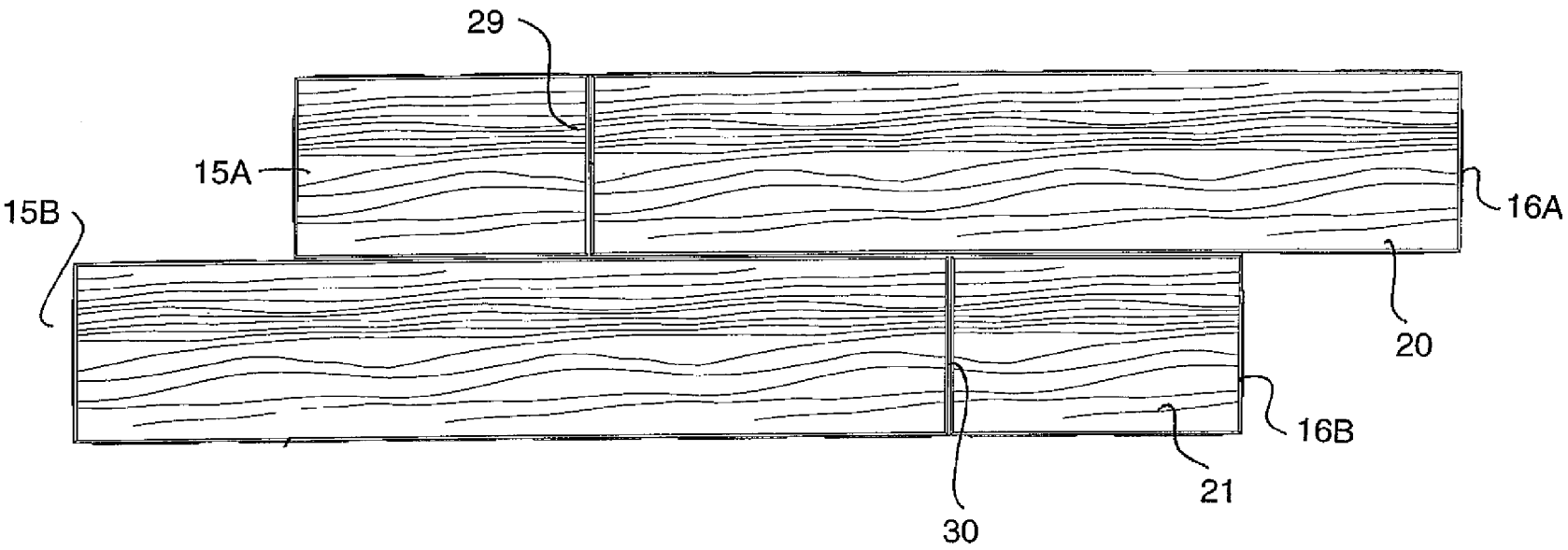
FIG. 4 is a top plan view of a fourth single cast concrete paving slab of the set of such slabs.

In FIGS. 3 and 4, each of the strips 20 and 21 has one slot 27, 28, 29, 30 in the upper surface defining a false joint and extending transverse to the length of the slab member at right angles to the sides so as to divide the upper surface into two end to end strips. It will be noted by comparing the four figures that the slot 25 is spaced from the end 15A by a different distance than the slot 26 from the end 15B. Also the slots 29 and 30 are spaced from the ends 15A and 16B by a different distance than the slots 27 and 28. This arrangement forms the strip portions defined by these false joints to be of different lengths, which provides a very varied appearance in the finished assembly as shown in FIG. 8. Thus in FIG. 8 the four above defined slabs are used in various location through the layout with each of the four marked by shading.

Each of the parallel strips of the slabs has a molded upper surface defining a series of wavy lines 40 recessed from other parts of the upper surface and simulating a wood grain appearance. The recessed wavy lines as they simulate the lines in wood grain form an array of generally parallel peaks 41 and valleys 42 where the valleys 42 are recessed from the surface 12.

The cast concrete contains a dye which colors it as close as possible to the brown wood color and the concrete material in the peaks 41 contains a dye 43 in the concrete which is different from the dye 44 in the other parts of the upper surface. Typically the dye 44 extends through the whole of the slab. Typically the dye 43 in the recessed wavy lines 40 is colored in contrast to that of the other parts, which could be lighter or darker. The different dye 43 in the recessed wavy lines is provided only in the concrete in the area of the recessed wavy lines 40 so that the remainder of the paving slabs is of a common color.

As shown in FIGS. 1 to 4, the simulated wood grain appearance of each of the strips of each of the slab members of the set has a pattern which is different from that of the others. Thus when assembled as shown in FIG. 8, the different lengths of the strips and the different patterns in the strips provides a particularly attractive appearance particularly effectively simulating the appearance of a wood floor.

In order to provide an effective wood grain appearance, the recessed wavy lines have a depth of recess from the remainder of the upper surface which is in the range 0.1 mm to 2.75 mm.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A set of cast concrete paving slabs arranged to be laid in a pattern to cover an area to be paved, the set of slabs comprising:

a plurality of slab members;

each slab member having a bottom surface for laying in the area and an upper surface for presenting for viewing when laid;

each slab member having a first side, a second side parallel to the first side, a first end and a second end;

the slab members being arranged to be laid side by side and end to end to cover the area;

each of the slab members having spacer abutments attached thereto at the sides and ends so as to hold an adjacent slab member at a predetermined spacing to form a spaced joint therebetween;

each of the slab members having at least one slot in the upper surface defining a false joint and extending along the length of the slab member parallel to the sides so as to divide the upper surface into a plurality of parallel strips;

each of the parallel strips having a molded upper surface defining a series of wavy lines recessed from other parts of the upper surface and simulating a wood grain appearance;

wherein only the recessed wavy lines contain a dye in the concrete which is different from and contrasting from that in the other parts of the upper surface.

2. The set of paving slabs according to claim 1 wherein each slab member consists of a single longitudinal slot defining two parallel strips.

3. The set of paving slabs according to claim 2 wherein the parallel strips have first ends at the first end of the slab member which are longitudinally offset.

4. The set of paving slabs according to claim 3 wherein the parallel strips have second ends at the second end of the slab member which are longitudinally offset by a distance equal to a distance of the offset of the first ends.

5. The set of paving slabs according to claim 1 wherein the parallel strips of each of the slab members of the set have first ends at the first end of the slab member which are longitudinally offset and have second ends at the second end of the slab member which are longitudinally offset by a distance equal to a distance of the offset of the first ends and equal to the distance of all the other slab members of the set.

6. The set of paving slabs according to claim 1 wherein at least one of the strips of at least one of the set has at least one slot in the upper surface defining a false joint and extending transverse to the length of the slab member at right angles to the sides so as to divide the upper surface into a plurality of end to end strips.

7. The set of paving slabs according to claim 1 wherein each of the strips of at least one of the set has at least one slot in the upper surface defining a false joint and extending transverse to the length of the slab member at right angles to the sides so as to divide the upper surface into a plurality of end to end strips.

8. The set of paving slabs according to claim 1 wherein each of the slab members of the set has two parallel strips wherein one of the strips of at least one of the set has one slot in the upper surface defining a false joint and extending transverse to the length of the slab member at right angles to the sides so as to divide the upper surface into a plurality of end to end strips and wherein both of the strips of at least one other of the set has one slot in the upper surface defining a false joint and extending transverse to the length of the slab member at right angles to the sides so as to divide the upper surface into a plurality of end to end strips.

9. The set of paving slabs according to claim 1 wherein the simulated wood grain appearance of each of the strips of each of the slab members of the set has a pattern which is different from the others.

10. The set of paving slabs according to claim 1 wherein the recessed wavy lines have a depth of recess from the remainder of the upper surface which is in the range 0.1 mm to 2.75 mm.

11. A set of cast concrete paving slabs arranged to be laid in a pattern to cover an area to be paved, the set of slabs comprising:

a plurality of slab members;

each slab member having a bottom surface for laying in the area and an upper surface for presenting for viewing when laid;

each slab member having a first side, a second side parallel to the first side, a first end and a second end;

the slab members being arranged to be laid side by side and end to end to cover the area;

each of the slab members having spacer abutments attached thereto at the sides and ends so as to hold an adjacent slab member at a predetermined spacing to form a spaced joint therebetween;

each of the slab members having at least one longitudinal slot in the upper surface defining a false joint and extending along the length of the slab member parallel to the sides so as to divide the upper surface into a plurality of parallel strips;

each of the parallel strips having a molded upper surface defining a series of wavy lines recessed from other parts of the upper surface and simulating a wood grain appearance;

wherein each of the slab members consist of a single longitudinal slot defining only two parallel strips;

wherein each of the slab members of the set are arranged such that the two parallel strips have first ends at the first end of the slab member which are longitudinally offset and have second ends at the second end of the slab member which are longitudinally offset by a distance equal to a distance of the offset of the first ends and equal to the distance of all the other slab members of the set;

wherein some of the slab members of the set has in each of the two parallel strips thereof a slot in the upper surface defining a false joint and extending transverse to the length of the parallel strip at right angles to the sides so as to divide the upper surface the strip into a plurality of end to end strip portions;

wherein some of the slab members of the set has in only one of the two parallel strips thereof a slot in the upper surface defining a false joint and extending transverse to the length of the parallel strip at right angles to the sides so as to divide the upper surface the strip into a plurality of end to end strip portions so that the other of the two parallel strips has no transverse slot and forms a continuous single strip.

12. The set of paving slabs according to claim 11 wherein the simulated wood grain appearance of each of the strips of each of the slab members of the set has a pattern which is different from the others.

13. The set of paving slabs according to claim 11 wherein the recessed wavy lines have a depth of recess from the remainder of the upper surface which is in the range 0.1 mm to 2.75 mm.

* * * * *